US005169505A

United States Patent [19]

Rotondi et al.

[11] Patent Number: 5,169,505

[45] Date of Patent: Dec. 8, 1992

[54] DEVICE FOR ELIMINATING LACK OF UNIFORMITY OF COATING ON EDGES OF ELECTROPLATED METAL STRIP

[75] Inventors: Orlando Rotondi, Collegno; Salvatore Pellizzi, Carmagnola, both of Italy

[73] Assignee: Ilva, SpA, Italy

[21] Appl. No.: 763,941

[22] Filed: Sep. 23, 1992

[30] Foreign Application Priority Data

Sep. 28, 1990 [IT] Italy ..... 48322 A/90

[51] Int. Cl.[5] ..... C25D 21/12; C25D 17/00

[52] U.S. Cl. ..... 204/208

[58] Field of Search ..... 204/208, 209; 205/96

[56] References Cited

U.S. PATENT DOCUMENTS 1,580,198 4/1926 Harrison ..... 204/208 X
2,725,355 11/1955 Gray ..... 204/208
3,261,770 7/1966 Judge ..... 204/208 X
3,627,665 12/1971 de Laminne ..... 204/209
3,697,399 10/1972 Usui ..... 204/208 X
4,401,523 8/1983 Avellone ..... 205/96

*Primary Examiner*—Donald R. Valentine
*Attorney, Agent, or Firm*—Allegretti & Witcoff, Ltd.

[57] ABSTRACT

A device for eliminating lack of uniformity of coating on the edges of an electroplated metal strip, for use on continuous electroplating lines, includes at least one optical sensor for detecting the presence of a joint between metal strips and optical sensors for determining changes in strip width. A variety of tools, e.g. cutters, are provided for cleaning the edges of the strip. Actuators are provided for moving the tools toward and away from the edges of the strip. Optical sensors are used to detect the position of the edges of the strip. Magnetic sensors, with pressure springs, optimize the position, pressure and contact angle of the tools vis-a-vis the strip.

6 Claims, 1 Drawing Sheet

DEVICE FOR ELIMINATING LACK OF UNIFORMITY OF COATING ON EDGES OF ELECTROPLATED METAL STRIP

BACKGROUND OF THE INVENTION

An object of the present invention is to provide a device for eliminating lack of coating uniformity on the edges of electroplated metal strip. In particular, the invention is designed for continuous electroplating plants, where it can automatically remove any eventual coating irregularities on the edges of the strip.

There is a particular problem in the continuous plating of metal strip with other protective metals (such as zinc, or alloys of zinc with other metals such as iron or nickel, in the case of steel) by means of electrolytic processes, namely the point effect. This concentration of electrical charges in zones characterized by marked curvature results in the deposit there having a particular morphology and a typical acicular appearance connected with uncontrolled crystal growth. This leads to problems in the plant, since deposits of such acicular products may form on the current-carrying rolls—with obvious consequences for the rolls themselves—and on the strip, as well as in subsequent stages of operations. Thus, for instance, when pressing car-body elements, the breakaway of these crystals may cause marks on the press-formed part and even damage the dies in the long run.

Attempts to eliminate these undesirable products have already been made, for instance, by trimming the edges of the strip at the end of the plating line. However, this method calls for voluminous cutting equipment which is costly and space-consuming. It also eliminates corrosion protection on the edges of the trimmed strip, which creates a further problem. Attempts have been made to use tools located after each plating unit in contact with the edges of the strip and controlled by counterweight systems. In this case the problem is the need to ensure the continuous positioning of the cutters against the strip edge for each of the cleaning devices used. The present invention overcomes these difficulties by providing a device which automatically ensures uniform cleaning of the edges, in all the various configurations which result from changes in width and thickness.

According to the present invention, in a plant for the production of continuously electroplated metal strip, a device is installed which is characterized by the combination of:

- means for detecting the presence of a joint between strips;
- means for detecting changes in strip width;
- a variety of tools for cleaning the strip edges;
- means for moving said variety of tools away from or towards the strip edges;
- means for detecting the positions of the strip edges; and
- means for optimizing tool position, pressure and contact angel vis-a-vis the strip.

After at least one electroplating unit and preferably at the end of the electroplating plant, the following items are arranged in succession in the direction of travel of the strip: a first set of sensors, optical for instance (such as photosensitive cells or image monitoring and processing systems) which detect the presence of a joint between strips, and a second set of sensors, also preferably optical, which provide information on changes in strip width (narrow to side or vice-versa).

In response to the signals sent by the sensors to the actuators, for instance of the electro-hydraulic or electro-pneumatic type, the latter can move the tools rapidly at right angles to the direction of travel of the strip, for instance, to ensure that the tools themselves, carried on special carriages, are not damaged as the result of a sudden shift in the position of the strip edge. In a successive zone there are other sensors, optical for example, whose task it is to guide the movement of the tools towards the operating positions on the edges of the strip, through the same actuators as above. Finally sensors, for example, of the inductive type, optimize tool position, pressure and contact angle vis-a-vis edges of the strip.

BRIEF DESCRIPTION OF THE DRAWING

The present invention will now be described in greater detail, with reference to a particularly preferred embodiment, illustrated purely by way of example but in no way limiting, in FIGURE 1.

DETAILED DESCRIPTION OF THE INVENTION

Figure 1:
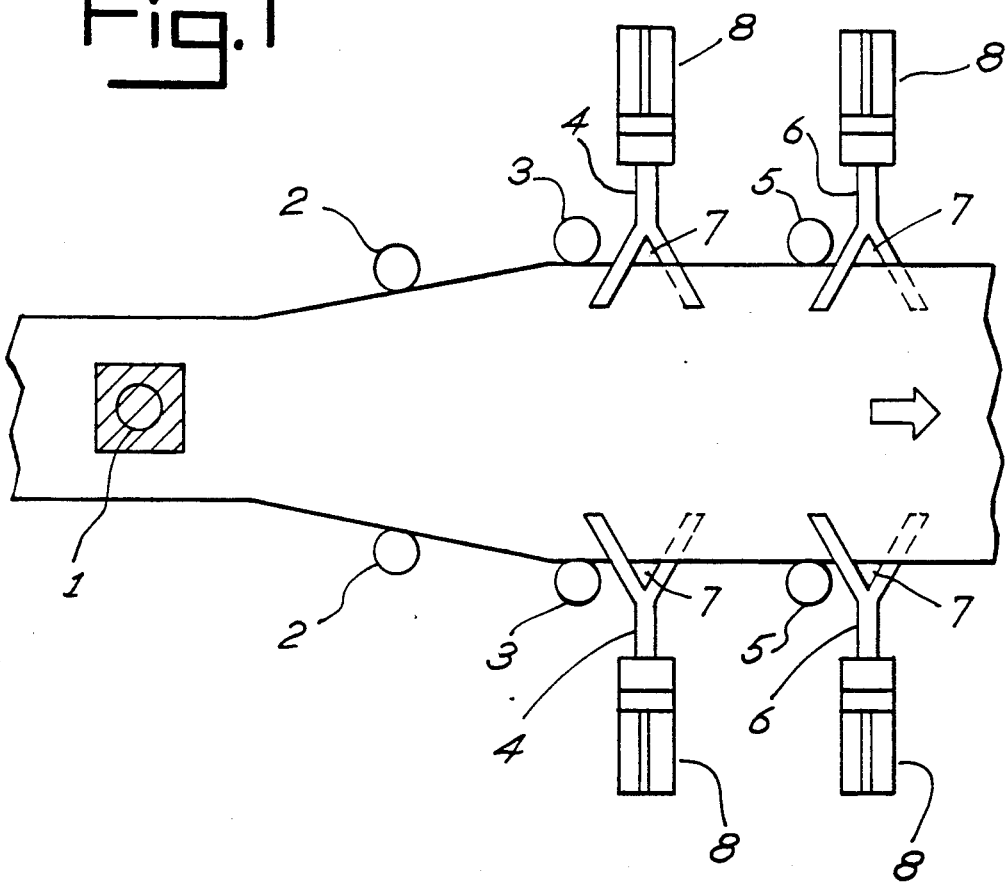

As can be seen in FIGURE 1, the following items are positioned along the direction of travel of the strip, indicated by the arrow: a first set of optical sensors (1) set astride the center line of the strip, a second set of optical sensors (2) on the sides of the strip, other optical sensors (3 and 5) located in the area of the tools (7) which are carried by metal forks (4,6), supported by tool-holder carriages (not shown in the FIG. 1) connected with actuators (8). The first set of optical sensors (1), consisting of photocells of the photoconductivity type, detects the presence of the weld and of a connected hole made to joint two coils so as not to interrupt process continuity, while the second set (2) detects changes in strip width. Said sensors end signals to the actuators (8), which are double-acting hydraulic rams that move the tools rapidly away from the edges of the strip.

A third set of optical sensors (3 and 5) consisting of two photocells for each side of the strip, takes account of the oscillations and changes in strip width that may have occurred in the horizontal plane during processing, and moves the tools towards the edges of the strip, via the same actuators. Fine-setting of the tools is achieved by means of magnetic sensors, complete with pressure spring, which transform an electrical impulse into mechanical movement, optimizing the position, pressure and contact angle so the tools vis-a-vis the strip.

It is important to note the different manner of operation of the tools (7) mounted on forks (4 and 6): the first pair has a negative rake and acts on the edges of the strip, scraping away protruberances formed by uncontrolled growth of crystals in that zone; the second pair is of the chamfered type and acts on the corners of the strip edges, refining and rounding them. The whole set-up is automatically calibrated so as not to uncover the strip, but to leave a certain thickness of coating even on the edges.

The present invention can thus be employed on a line for electroplated strips of different widths and thicknesses, since it automatically removes the uneven coating deposited on the edges of the strip, thus optimizing product quality and ensuring a good appearance, while being easy to install in diverse plants and cycles, and reasonably economical in application and construction.

While we have disclosed a presently preferred embodiment of the invention, it will be apparent to those skilled in the art that other embodiments are permissible within the scope of the following claims.

We claim:

1. A device for eliminating lack of uniformity of coating on edges of electroplated metal strip, for use on continuous electroplating lines, characterized by the combination of:

means for detecting the presence of a joint between strips; means for detecting changes in strip width; a variety of tools for cleaning the strip edges; means for moving said variety of tools away from or towards said strip edges; means for detecting the position of the strip edges; and means for optimizing tool position, pressure and contact angle vis-a-vis the strip.

2. A device for eliminating lack of uniformity of coating on edges of electroplated metal strip, as per claim 1, characterized by the fact that the means which detect the presence of the joint between strips consist of at least one optical sensor set astride the center line of the strip, said means for detecting changes in strip width also comprising optical sensors, and functioning to ensure the fact sideway removal of the tools through at least one pair of actuators.

3. A device for eliminating lack of uniformity of coating on edges of electroplated metal strips, as per claim 1, characterized by the fact that the means for detecting the position of the edges of the strip are optical sensors which control the movement of the tools towards the edges of the strip through the aforesaid actuators.

4. A device for eliminating lack of uniformity of coating on edges of electroplated metal strip, as per claim 1, characterized by the fact that the means for optimizing the position, pressure and contact angle between tool and strip consist of at least one pair of magnetic sensors with pressure spring.

5. A device for eliminating lack of uniformity of coating on edges of electroplated metal strip, as per claim 1, characterized by the fact that the variety of tools are fixed to at least two pairs of metal forks and perform diverse actions, one pair works on the edges of the strip and is characterized by a negative rake, while another pair works on the corners of the edge of the strip and is of the chamfered type.

6. A device for eliminating lack of uniformity of the coating on the edge of electroplated metal strip, for use on continuous electroplating lines, comprising in combination: means for detecting the presence of a joint between adjacent strips; means for detecting changes in width of said strip; tool means for cleaning the edges of said strip; means for moving said tool means toward and away from the edges of said strip; means for detecting the position of the edges of said strip; and means for optimizing position, pressure and contact angle of said tool means vis-a-vis said strip.

* * * * *

UNITED STATES PATENT AND TRADEMARK OFFICE

CERTIFICATE OF CORRECTION

PATENT NO. : 5,169,505

DATED : December 8, 1992

INVENTOR(S) : Rotondi and Pellizzi

It is certified that error appears in the above-identified patent and that said Letters Patent is hereby corrected as shown below:

On the Title Page, Item [22]; the recitation "Filed: September 23, 1992" has been changed to -- Filed: September 23, 1991 -- .

Signed and Sealed this

Twelfth Day of July, 1994

*Attest:*

Bruce Lehman

BRUCE LEHMAN

*Attesting Officer*

*Commissioner of Patents and Trademarks*